United States Patent [19]

Turner

[11] Patent Number: 4,875,411

[45] Date of Patent: Oct. 24, 1989

[54] RANDOM LOTTO MARKER

[76] Inventor: Lanny Turner, 72 Bedford St., New York, N.Y. 10014

[21] Appl. No.: 325,076

[22] Filed: Mar. 16, 1989

Related U.S. Application Data

[63] Continuation of Ser. No. 229,562, Aug. 5, 1988, abandoned.

[51] Int. Cl.[4] ..... B41K 1/42

[52] U.S. Cl. ..... 101/333; 101/405; 101/407.1; 273/138 A; 273/269

[58] Field of Search ..... 101/405, 407.1, 333; 273/269, 138 R, 138 A, 139, 144 B, 150, 58 F, 282, 284, 274, 118 R, 236, 237, 123, 243, 240

[56] References Cited

U.S. PATENT DOCUMENTS

| | | | |
|---|---|---|---|
| 1,231,505 | 6/1917 | Denney . | |
| 2,673,518 | 3/1954 | Ardizzone . | |
| 3,260,192 | 7/1966 | Ostenberg . | |
| 3,403,623 | 10/1968 | Blackwood . | |
| 3,770,269 | 11/1973 | Elder | 273/138 A |
| 4,087,092 | 5/1978 | Krause et al. | 273/138 A |
| 4,172,419 | 10/1979 | Munyon . | |
| 4,274,638 | 6/1981 | Jullien | 273/269 |
| 4,541,333 | 9/1985 | Sillars | 273/138 R |
| 4,628,816 | 12/1986 | Six | 101/426 |
| 4,756,531 | 7/1988 | Dire et al. | 273/138 A |

FOREIGN PATENT DOCUMENTS

| | | | |
|---|---|---|---|
| 1094170 | 12/1960 | Fed. Rep. of Germany | 273/144 B |
| 2560057 | 5/1985 | France | 273/269 |
| 1418690 | 12/1975 | United Kingdom | 273/138 R |

*Primary Examiner*—Eugene H. Eickholt

*Attorney, Agent, or Firm*—Amster, Rothstein & Ebenstein

[57] ABSTRACT

A portable hand-operated mechanical marker for making a random wager selection comprises a first portion for generating a substantially random first pattern, and a second portion for marking a sheet in a second pattern determined by the first pattern. Typically the marker is used to mark a lotto card with a randomly selected bet.

22 Claims, 5 Drawing Sheets

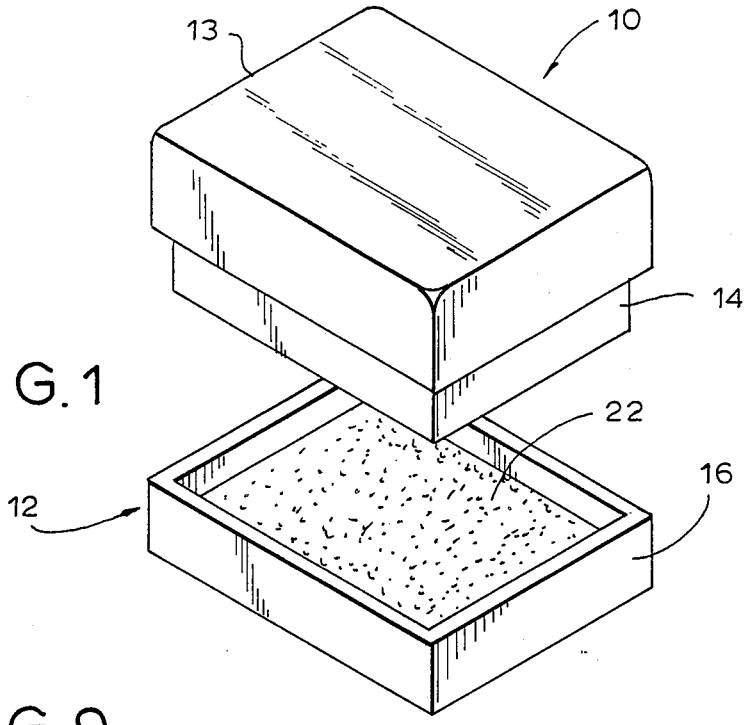
FIG. 1
FIG. 9
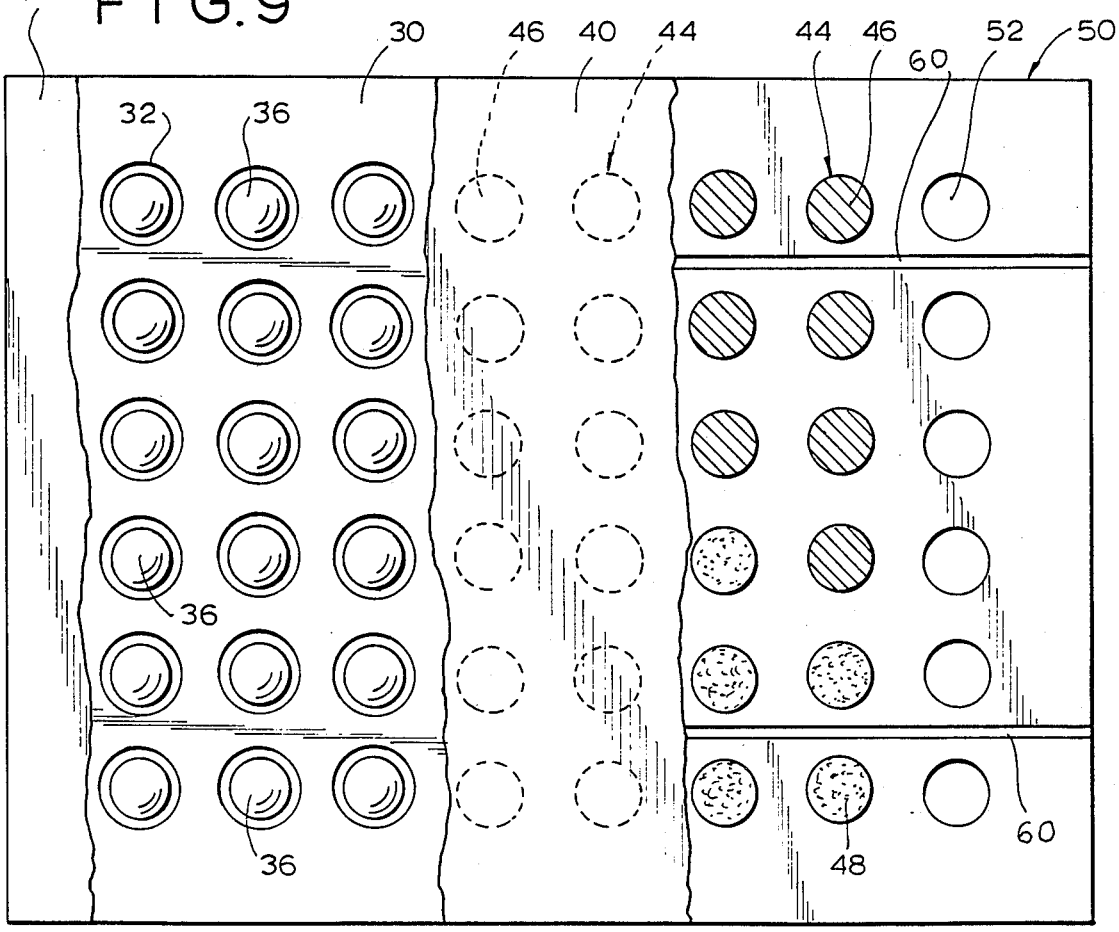

RANDOM LOTTO MARKER

This is a continuation of co-pending application Ser. No. 229,562, filed on Aug. 5, 1988, and now abandoned.

BACKGROUND OF THE INVENTION

The present invention relates to portable hand-operated mechanical apparatus for making and marking a wagering selection on a wager card and, more particularly, to such apparatus for making a random wagering selection and printing it on a lotto card.

Lotto is a game of chance played with numbered counters selected by lot or other markers selected by lot to be placed upon the corresponding numbers on the players' boards— e.g., bingo. More generally, and as used in the Lottery game sponsored by the State of New York, the player's card contains, for each game, an array or matrix of numbers (48 in Lotto 48) arranged in rows and columns (6×8 in Lotto 48). To enable wagers who are looking for particular numbers to quickly locate those numbers on a card, the numbers for a given game are always in numerically ascending sequence in a given row, with successive columns having successively higher numbers. Thus any design or pattern which is used to make the selections will determine the numbers selected. The selected numbers are indicated by marking them on the card—e.g., inking out each selected number. Each game requires the selection of a plurality of numbers, typically 6. Each card contains ten separate "games", and the card may be validated for 2, 4, 6, 8 or 10 games depending upon the fee paid. Thus a player intending to play the entire card of 10 games must make and mark 60 selections of numbers, a time-consuming process at the very best.

Adding to the time consumed in making the wagering selection are the propensities of the wagerers. "Hunch" wagerers prefer to play favorite numbers or hunches and must locate in each game their favorite number, their second favorite number, etc., until the six favorite numbers have been located and marked. The present invention is not directed to these wagerers. At the opposite end of the spectrum from these "hunch" wagerers, are the "random" wagerers who prefer to ride the winds of chance and allow, for example, a random design to determine the selected numbers in each game. Of course, even such "random" bettors are aware that no such desired selection is truly random—for example, an individual bettor may have an unconscious preference for numbers on the periphery of the game, in a corner thereof, or in the center thereof. Further, as he marks his selections upon the card, he is viewing the numbers and there is the possibility of particular numbers unconsciously affecting his pattern selection one way or another. While such a "random" wagerer typically marks a game faster than the "hunch" wagerer, attempts to maintain random designs, preferably different random designs, over up to 10 games per card and possibly many cards at a given time, can make the random betting operation even more time-consuming. It is to these "random" bettors that the present invention is directed.

From the point of view of the bettor, the time spent making the selections and placing his wager are part of the betting process and possibly one of the more enjoyable aspects. On the other hand, from the point of view of the bet-taking operator—which may be a news stand on the street, a coffee shop, a drug store or a cashier at just about any establishment—a speed up in the bet-placing operation means increased turnover and increased business. Even though multiple cards may be handed out for marking at a given time, in the usual situation where the bet-taking operation has only a very limited space for the wagerers to congregate and mark their cards, space may be the limiting factor and a faster bet selection and marking process is the equivalent of an increase in the available space. The presence of a particularly large prize or "pot" can result in customer lines of such a magnitude that it may take a half hour or more to place a bet, thus discouraging potential wagerers.

Another problem encountered by the bet-taking operator is that frequently the selected numbers are not marked sufficiently clearly by the wagerer to enable the electronic equipment to detect the marking and hence the number selection. In that case the card must be returned to the user for re-marking, thus presenting a further bottleneck in the bet-taking operation.

Accordingly, it is an object of the present invention to provide a mechanical apparatus for making a random wagering selection.

Another object is to provide such apparatus which is convenient, easy and rapid to use.

A further object of the present invention is to provide such apparatus which generates a substantially random pattern for each game.

It is also an object to provide such apparatus which marks the wagering sheet clearly and accurately according to the generated pattern.

It is another object to provide such apparatus which enables the "random" wagerer to clearly and accurately place truly random wagers in a minimum of time.

It is a further object to provide such apparatus which may be hand-operated, compact, portable and safe to carry.

SUMMARY OF THE INVENTION

It has now been found that the above and related objects of the present invention are obtained in apparatus for making a random wagering selection. The apparatus comprises basically means for generating a substantially random first pattern, and means for marking a sheet in a second pattern determined by the first pattern. The apparatus is preferably portable, hand-operated and mechanical.

In a preferred embodiment the second pattern is essentially the same as the first pattern and constitutes the wager selection which is printed on a wagering sheet. More particularly, the random generating means comprises a cage and a plurality of balls randomly movably disposed in a horizontal plane of the cage, the balls assuming a first pattern after the cage is randomly shaken. The marking means comprises a plurality of independently selectable marking elements, a vertical alignment of one of the balls and one of the marking elements being required for the one marking element to mark the sheet.

The cage is movable between a vertically extended normal configuration enabling random horizontal movement of the balls in the cage and a vertically collapsed printing configuration fixing the balls against horizontal movement within the cage and forcing the balls downwardly to operatively vertically depress the vertically aligned marking elements to their operative position. The marking elements are independently movable between inoperative and operative positions, a marking element in the inoperative position being longitudinally elevated and a marking element in the operative position being longitudinally depressed. The apparatus additionally includes a downwardly extending lip for maintaining the marking elements in the inoperative position spaced from the sheet while enabling the marking elements in the operative position to engage the sheet.

The present invention further encompasses the combination of the apparatus and a separable base adapted to receive the apparatus, the base having an upper surface defining a downwardly extending groove adapted to receive therein a lower portion of the lip. The base contains an upwardly facing ink reservoir adapted to be operatively engaged by the marking elements in the inoperative position when the base groove receives the lower lip portion, whereby the marking elements are maintained inked and ready for marking.

The apparatus additionally includes means active on the cage and biasing it to its vertically extended normal configuration. The upper surface of the floor of the cage preferably defines a plurality of centering depressions, each of the centering depressions being vertically aligned with a respective of the marking elements. The plurality of marking elements and the plurality of centering depressions are disposed in vertically aligned matrices.

The apparatus includes means active on each of the marking elements and biasing them to their inoperative positions, preferably a single common biasing means (such as a thin elastic membrane) active on each of the marking elements. Each of the marking elements is secured to the biasing means for vertical movement therewith.

BRIEF DESCRIPTION OF THE DRAWING

The above brief description, as well as further; objects and features of the present invention, will be more fully understood by reference to the following detailed description of the presently preferred, albeit illustrative, embodiments of the present invention when taken in conjunction with the accompanying drawing, wherein:

FIG. 1 is an isometric view of apparatus according to the present invention and the separable base therefor, the two elements being shown separate;

FIG. 9 is a top plan view of the apparatus with successive portions thereof removed to reveal details of internal construction.

DETAILED DESCRIPTION OF THE PREFERRED EMBODIMENTS

Figure 3:
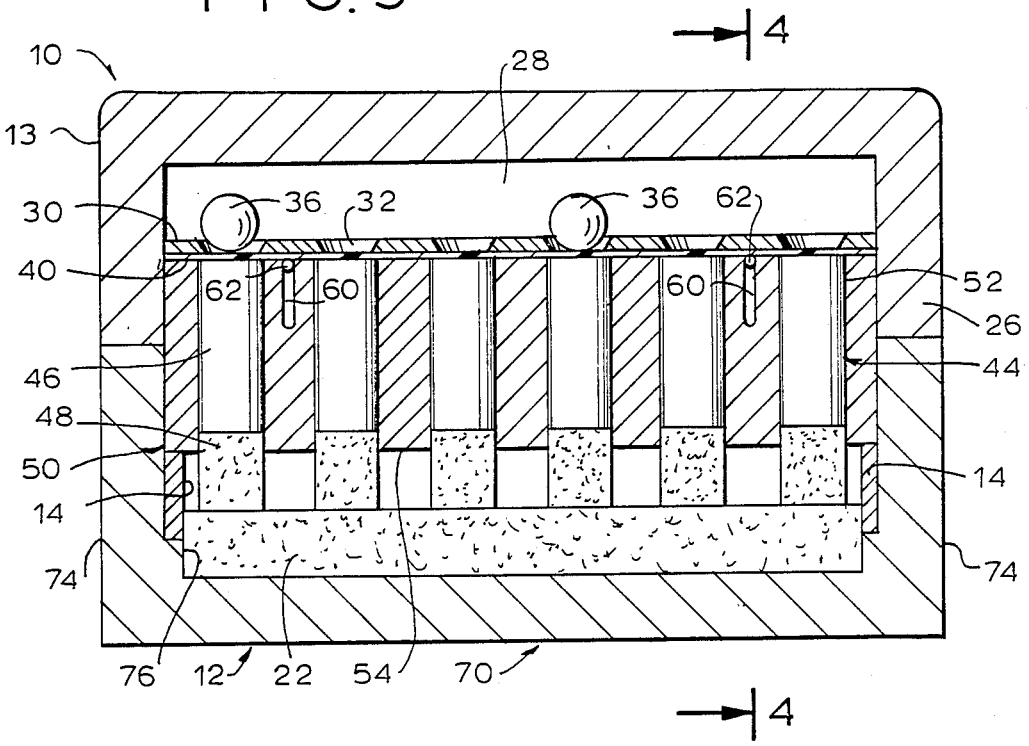
FIG. 3 is a side elevation view, in cross section, of the apparatus mounted on the base.
Figure 4:
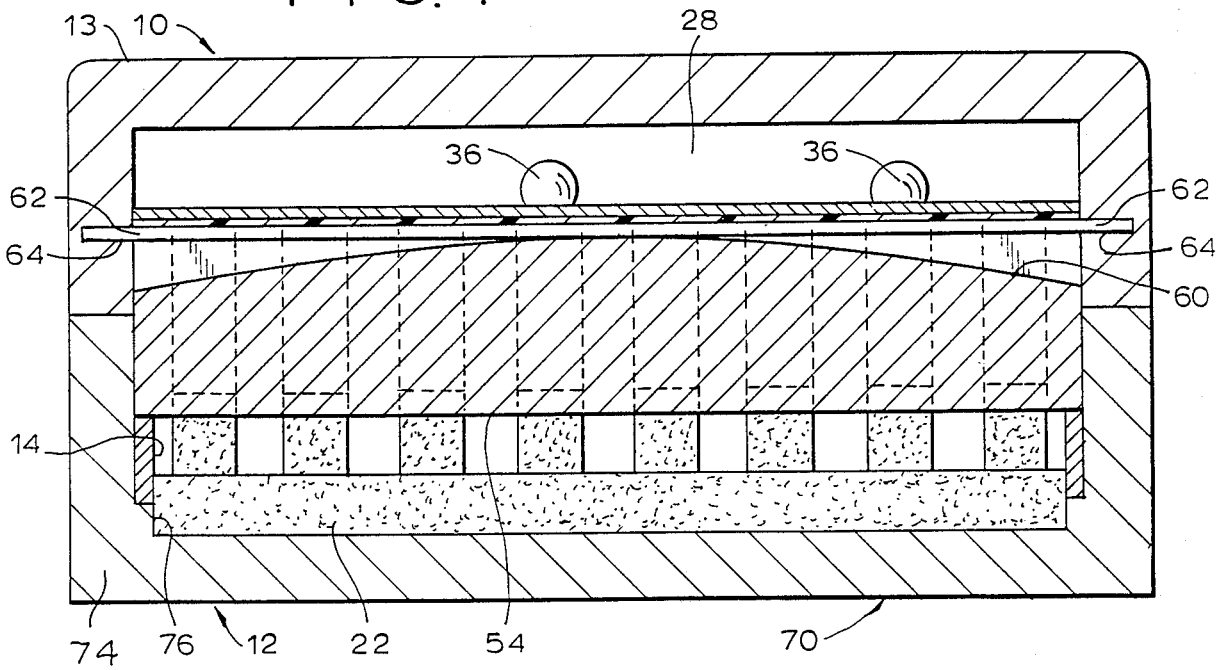
FIG. 4 is a front elevation view thereof, taken along the line 4—4 of FIG. 3 and in the direction of the arrows.

Referring now to the drawing and in particular to FIG. 1 thereof, therein illustrated is a portable hand-operated mechanical apparatus, generally designated by the reference numeral 10, and the separable base therefor, generally designated 12, both according to the present invention. The apparatus 10 has a lower lip 14 adapted to fit snugly within the base 12, as best seen in FIGS. 3 and 4.

Figure 2:
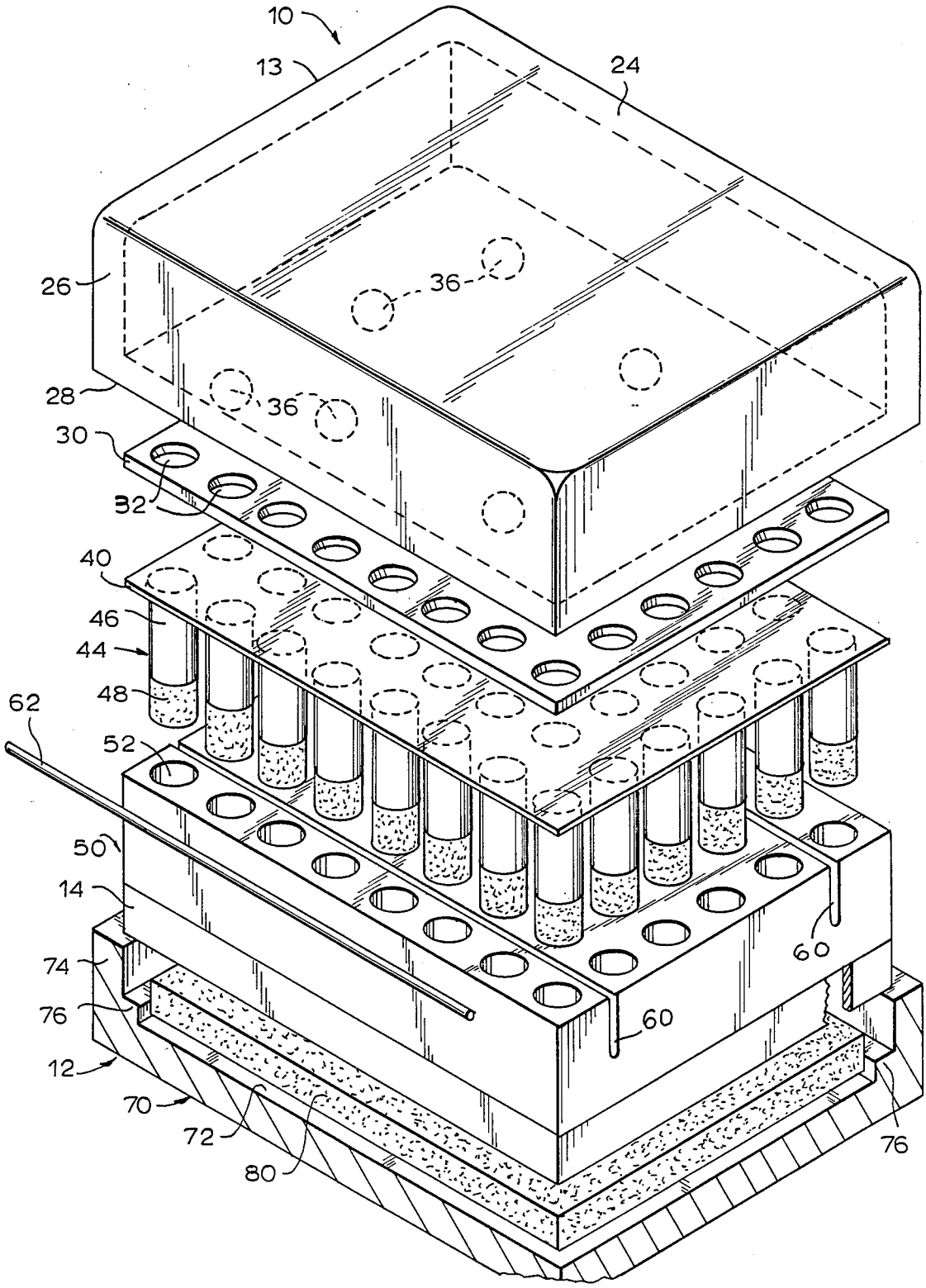
FIG. 2 is an exploded isometric view, to a greatly enlarged scale, of the assembly of the apparatus and base with portions cut away to reveal details of internal construction.

Referring now to FIG. 2 in particular, therein illustrated is the apparatus 10 mounted on the base 12. The apparatus housing 13 defines generally a rectangular top wall 24 having a depending sidewall 26 about its entire periphery. Thus the housing 13 defines an open-bottom chamber 28 (see FIGS. 3 and 4).

A substantially rigid sheet member 30 defines an array or matrix of apertures 32 therethrough. The number and disposition of the apertures 32 defining the array or matrix of apertured member 30 is determined to coincide with the numbers on a game of the lotto card. The apertures 32 may be strictly cylindrical, as illustrated in FIG. 2, but preferably they have a slightly beveled concave upper surface thereabout, as illustrated in FIG. 9. The apertured member 30 fits within the housing sidewall 26 and cooperates with the housing 13 to convert the open bottom chamber 28 into a cage open only at the apertures 32 at the bottom thereof. It will be appreciated that while the length and width of the cage 28 are fixed, the height thereof is a variable dependent upon the extent to which the apertured member 30 is spaced from the housing top wall 24.

A plurality of small inflexible ball bearings or spheres 36 are disposed within the cage 28, the number of bearings 36 being equal to the number of numbers to be selected in a particular game. The apertures 32 preferably have a slightly concave upper surface thereabout, as illustrated in FIG. 9, to assist in centering the bearings 36 with respect thereto. The apertured member 30 is adapted for vertical movement relative to housing top wall 24 between a normal depressed position wherein the cage 28 is of sufficient vertical height to enable free movement of the bearings 36 between the top surface of the apertured member 30 and the bottom face of the housing top wall 24, and an elevated position wherein the vertical cage height is reduced so that the lower surface of the housing top wall 24 forces the bearings 36 into the apertures 32 so that they cannot move laterally and so that at least an appreciable portion of the bearings 36 extends below the bottom surface of the apertured member 30.

The extent to which the bearings 36 project downwardly below the bottom surface of the apertured member 30 ultimately determines the clarity of the distinction between a marked selected number and a non-marked, non-selected number on the lotto card. The diameter of the bearings 36 must be large enough so that the forced movement together of the housing top wall 24 and apertured member 30 substantially depresses the bearings 36 further into and through aperture 32. Generally, on the other hand, the diameter of the bearings 36 should be slightly less than the diameter of the apertures 32 so that the bearings 36 may be depressed without impedance from the apertures 32. The bearings 36 are preferably hollow to minimize their moment of inertia and facilitate their displacement from the apertures 32 by shaking and by the biasing membrane to be described immediately hereinbelow.

A biasing member 40 is disposed immediately below the bottom face of the apertured member 30 and within the housing sidewall 26. The biasing member 40 is a thin elastic elastomer which can be locally stretched and depressed by a bearing 36 being pressed through the apertured member 30, but which resiliently snaps back to its planar configuration after the downward pressure of the bearing 36 is released. Conventional natural and artificial rubbers are highly suited for this purpose.

A plurality of marking elements, generally designated 44, are independently and individually secured to the bottom face of the biasing membrane 40. Each marking element 44 is of cylindrical configuration and disposed in vertical alignment with its respective aperture 32 of the apertured member 30. Preferably the marking elements 44 are of the same diameter as the apertures 32 but may be somewhat wider or narrow depending, for example, upon the space to be marked on the lotto card to select a particular number. The top end of the marking element 44 may be secured to the lower face of the biasing membrane 40 by glue, adhesive, or other means carefully selected not to have an adverse effect on the resilient properties of the biasing membrane 40. For example, certain glues adversely effect the longevity of particular rubbers and the combination of such glues and such rubbers should be avoided.

The upper portion 46 of each marking element 44 is preferably formed of a relatively incompressible or rigid plastic which will displace downwardly (rather than collapse or partially compress) when depressed by a bearing 36 acting through the biasing membrane 40. The lower portion 48 of each marking element 44 is formed of an ink-absorbent material, such as felt or cotton. It may be secured to the upper portion 46 of the marking element 44 by glue, adhesive or the like. Alternatively, if desired, the bottom end of the upper portion 46 may define a recess and the upper end of the lower portion 48 may be stuffed into the recess of the upper portion 46 and frictionally maintained therein so that the upper and lower portions 46, 48 move together as a single marking element 44. The composition of the lower portion 48 typically has a certain amount of compressibility or give (as a result of the selection of the material for its ink-absorbency) and would thus reduce the extent of travel of the lower end of the marking element 44 relative to the extent of travel of the bearing 36 below the bottom face of the apertured member 30. Accordingly, the vertical length of the lower portion 48 is preferably substantially less than the vertical length of the upper portion 46. Nevertheless, as will become apparent hereinafter, the lower portion 48 should be of sufficient length to enable it to carry sufficient ink for marking a number of games between return trips to the ink pad. This enables the apparatus to be used for several games before the apparatus must be returned to the base 12, thereby further minimizing the time required to mark the lotto card.

Disposed immediately below the biasing membrane 40 and around the marking elements 44 is a body 50 having vertically extending channels 52 therethrough aligned with and adapted to receive the marking elements 44. The body 50 is made of an incompressible, inflexible material such as plastic. The upper portion of body 50 is disposed within the housing sidewall 26. The body 50 has a vertical height which is greater than the vertical height of the upper portion 46 of the marking element 44, but less than the combined heights of the upper and lower portions 46, 48 of the marking element 44. Thus, the lower felt-tip portion 48 of the marking element 44 extends below the body bottom surface 54 (see FIGS. 3 and 4).

The body 50 is provided with a peripheral lower lip 14 which extends below the body bottom surface 54 and further below the bottom ends of the marking elements 44 in their normal orientation. The lower lip 14 is effective to maintain the marking elements 44, when in their normal orientation, spaced above the lotto card or any other flat surface on which the apparatus 10 is rested. This prevents the ink in the marking elements 44 from being used unnecessarily and flat surfaces from being unexpectedly inked.

The apertured member 30, the biasing membrane 40 (and its attached marking elements 44), and the body 50 form a subassembly which is vertically movable as a unit relative to the housing 13. To this end the elements 30, 40 and 50 of the subassembly are joined together, for example, by peripheral margins of adhesive or other fastening means intermediate the biasing membrane 40 and both the apertured member 30 and the body 50. The subassembly maintains the biasing membrane 40 relatively taut, precluding its permanent deformation or bunching under the local deforming pressure of the bearings 36.

The upper surface of the body 50 defines two convex curves extending the full length of the body 50. One curve 60 is disposed intermediate the front row of apertures 52 and the adjacent row thereto, while the other curve 60 is disposed intermediate the back row of apertures 52 and the adjacent row thereto. Referring now to FIGS. 3–8, immediately below the biasing membrane 40 and tangent to the uppermost point of each convex curve 60 is a resilient rod 62. The resilient rod 62 is preferably formed of 22 gauge spring steel wire, although other resilient metals, plastics and the like may be used. The ends of the resilient rod 62 are journaled in apertures 64 of the adjacent ends of the housing sidewall 26. Preferably journal apertures 64 do not extend through the outer surface of the housing sidewall 26, but only inwardly from an interior point, thereby affording a cleaner, more attractive appearance to the apparatus and also minimizing moisture and hence ink loss as the apparatus 10 sits upon its base 12, as will be illustrated hereinafter.

The purpose of the resilient rods 62 is to bias the body 50 (and thus the entire subassembly) downwardly, away from the housing top wall 24. The downward movement of the body 50 resulting from the action of the biasing rods 62 on the top portion of the curves 60 of body 50. Due to the interconnnected nature of the subassembly, the biasing rods 62 also cause the downward movement of the resilient biasing membrane 40 (and the marking elements 44 secured thereto) and the apertured member 30, so that the cage 28 normally maintains its expanded vertical height (see FIGS. 3–6). On the other hand, when the housing top wall 24 is depressed and the cage 28 assumes its collapsed vertical height, the housing sidewall 26 moves down relative to the subassembly and its body 50 and the body curve 60, so that the biasing rod 62 is flexed convexly. It will be appreciated that the axial length of the resilient rod 62, the axial length of the housing sidewall holes 64 and the curvature of the curve 60 are selected to insure that even when the resilient rod 62 is undergoing maximum deflection (see FIGS. 7–8), its ends are still trapped within the housing sidewall apertures 64 and do not become displaced therefrom. The depth of the curve 60 at its highest point (that is, its center point) is approximately equal to the thickness of the resilient rod 62. The biasing membrane 40 and the curves 60 cooperate to limit both the upward and downward travel of the subassembly relative to the housing 13 and to provide dampening of the resilient rods 62 when they are released from their stressed convex orientation and permitted to assume their relaxed linear or straight orientation.

The apparatus 10 is intended for use with a base 12, the apparatus 10 and base 12 forming a self-contained leak-proof case or unit which minimizes drying out of the ink due to atmospheric exposure, isolates the marking elements 44 so that they cannot accidentally mark anything, and at the same time maintaining the marking elements in an inked and ready-to-use state. The height and width of the unit need be only slightly greater than the that of a single game on the wagering sheet. The base 12 comprises a housing generally designated 70 and including a bottom wall 72 and stepped sidewall 74 upstanding therefrom. The base bottom wall 72 is configured and dimensioned as in the aperture housing top wall 24, and the top surface of the base sidewall 74 is adapted to receive thereon the bottom surface of the housing sidewall 26. Disposed within the central space defined by the step 76 of the base sidewall 74 is an ink pad 80 extending higher than the step 76. When the lower lip 14 of the apparatus 10 rests on the upper surface of the base sidewall step 76, with the marking elements 44 in a normal elevated orientation, the ink pad 22 contacts the absorbent portion 48 of each marking element 44 to keep it freshly supplied with ink. The ink pad 22 is of conventional design and may be formed of an absorbent material having a substantial ink-bearing capacity, large numbers of easily ruptured ink-bearing microcells, or the like.

The apparatus housing 13, the apertured member 30, the body 50, and the base housing 70 may all be formed of a rigid plastic, the apparatus housing 13 preferably being formed of a transparent rigid plastic to enable the wagerer to determine that all of the bearings 36 are disposed in apertures 32. A preferred material for all these elements is Lucite, a trade name for a plastic based on polymerized methyl methacrylate resin.

Referring now to FIGS. 3 and 4, during storage, carrying or, as necessary, reinking of the apparatus, the apparatus 10 is mounted on the base 12 to form a fluid-tight, relatively self-contained unit in which the marking elements 44 are shielded from contact with clothing and the like, while at the same time being maintained in contact with an ink pad 80 so that they are maintained in an inked and ready-to-use state. In the unit, the bottom surface of the apparatus housing sidewall 26 rests on the top surface of the base sidewall 74, with the bottom surface of lower lip 14 of the apparatus housing 13 resting on the top surface of the base sidewall step 76. The marking elements 44 are all disposed in the same horizontal plane as the cage 28 is in an expanded state and there is no pressure being exerted to force any of the bearings 36 downwardly. In this configuration, the biasing rod 62 is unstressed and substantially straight, i.e., horizontal. The absorbent lower portions 48 of the marking elements 44 need contact the upper surface of the ink pad 80 only with sufficient force to insure a satisfactory ink-transferring contact between the pad 80 and the marking elements 44.

In order to dispose the bearings 36 in a random pattern, the entire unit may be shaken or the apparatus 10 may be removed from the base 12 and separately shaken, optimally in a horizontal plane for true randomness. The six bearings 36 within the expanded cage 28 will depart the apertures 32 of the apertured member 30 and assume random positions during the shaking. Once the shaking is terminated, the bearings 36 will tend to come to rest within apertures 32 of the apertured member 30, thereby defining a random pattern. The assumption of positions within apertures 32 is aided if the apertures 32 form at their top slight peripheral depressions leading the bearings 36 into the apertures 32. If a group of bearings 36 are caught in a corner or otherwise boxed together such that one or more of the bearings 36 are not disposed within an aperture 32, then the apparatus 10 may be vigorously shaken again. If one or more of the bearings 36 is simply resting on top of the apertured member 30 and not in an aperture 32 thereof, a slight shaking of the apparatus 10 will suffice generally to relocate the errant bearing 36 into an aperture 32 without displacing the other bearings 36 from their apertures 32. If the shaking was performed with the apparatus 10 forming part of the unit with the base 12, the apparatus 10 is now lifted away from the base 12.

Figure 5:
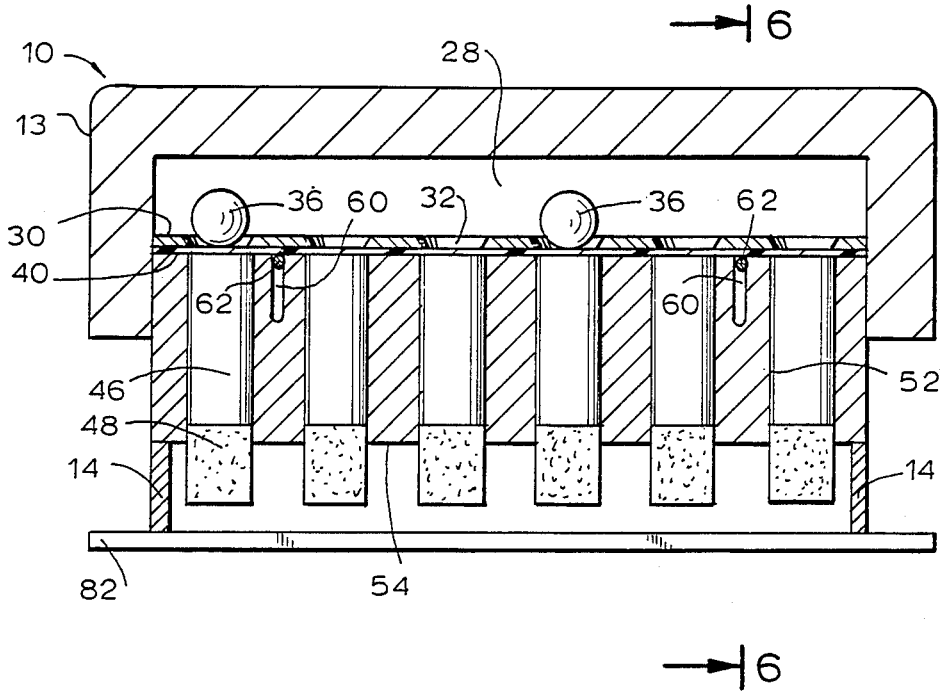
FIGS. 5 and 6 are views similar to FIGS. 3 and 4, but showing the apparatus resting on a lotto card.
Figure 6:
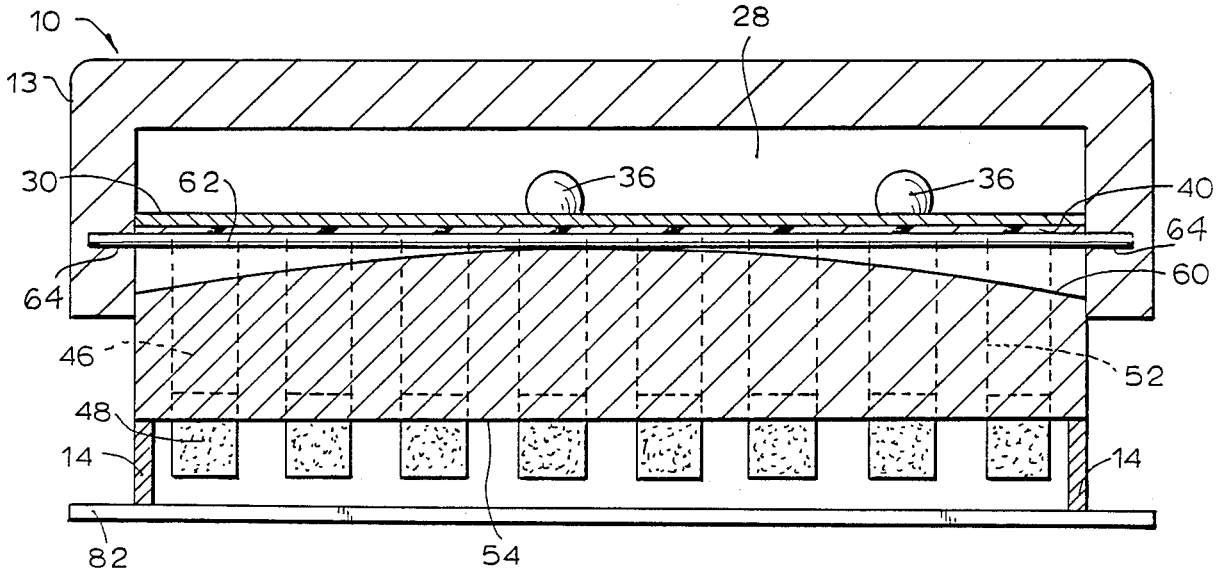

Referring now to FIGS. 5 and 6, the apparatus 10 is now placed over a wagering sheet 82, such as a lotto card, with the bottom surface of the lower lip 14 resting on the upper surface of the card 82 and spacing the absorbent portions 48 of the marking elements 44 above the upper surface of the card 82. A comparison of FIGS. 5 and 6 with FIGS. 3 and 4 illustrates that the apparatus 10 itself has not undergone any change, but only that the lotto card 80 has been substituted for the base 12, with the result that the apparatus 10 is supported by the apparatus lower lip 14 rather than the apparatus housing sidewall 26. Typically the resiliency of the biasing rod 62 is sufficiently strong that it resists deflection even though the apparatus housing 13 is no longer being supported by the base housing 70.

It is recognized that, during the transfer of the apparatus 10 from the base 12 and to the lotto card 82, there may be some further movement of the bearings 36 within the still vertically expanded cage 28. This additional movement is, however, as randomly generated as that caused by the deliberate shaking and is therefore consonant with the principles of the present invention.

Figure 7:
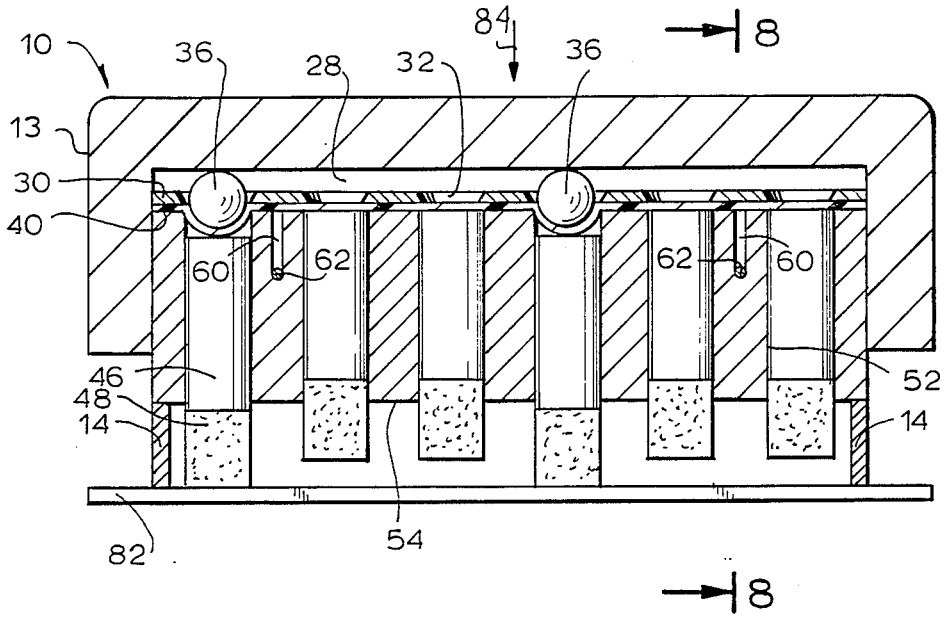
FIGS. 7 and 8 are views similar to FIGS. 5 and 6, but showing the apparatus being pressed downwardly against the lotto card to mark it with the appropriate randomly selected wager.
Figure 8:
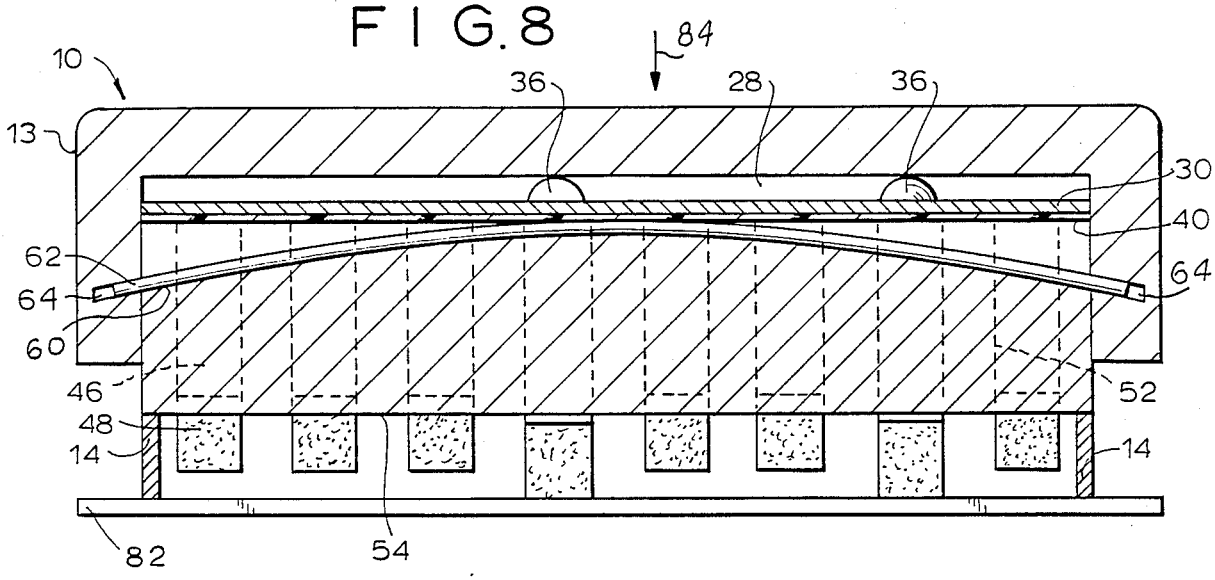

Referring now to FIGS. 7 and 8, manual pressure is now applied downwardly on the apparatus housing 13, in the direction of the arrow 84. This moves the cage 28 into its vertically collapsed printing configuration. More particularly, the bottom surface of the apparatus housing top wall 24 contacts and exerts pressure on the top of the bearings 36. This downward pressure on the bearings 36 causes them to pass further into and further through the apertures 32 of the apertured member 30 and to downwardly deflect vertically aligned local areas of the resilient membrane 40 and, in turn, the marking elements 44 associated therewith. The ink-containing absorbent portions 48 of the marking elements 44 which have been depressed contact the upper surface of the lotto card 82 and select (i.e., mark) the numbers disposed thereunder. It will be appreciated that only the marking elements 44 which are vertically aligned with the bearings 36 are depressed, and the selection of a particular number on lotto card 82 is a result of the vertical alignment of that number, a marking element 44 and a bearing 36. The depression of the apparatus housing 13, and in particular the sidewall 26 thereof, stresses the biasing rod 62 and causes it to deflect convexly and lie against the curve 60 of the body 50. As a result, there is some retreat of the ends of the biasing rod 62 from the housing sidewall apertures 64, but not enough to enable withdrawal of either end from an aperture 64.

Upon release of the downward pressure, the apparatus 10 re-assumes the configuration illustrated in FIGS. 5 and 6. The biasing rod 62 causes a relative separating movement of the body 50 and housing 13, thereby relieving the stress imposed upon it by its convex curvature under the deforming downward pressure indicated by arrow 84. As the biasing rod 62 returns to its nonstressed linear configuration, it displaces the body 50 downwardly from the housing 13 so that the cage 28 resumes its normal extended vertical configuration. This in turn permits the resilient membrane 40 to resume its normal planar configuration so that the bearings 36 are partially lifted out of the apertures 32 of the apertured member 30 and thus easily displaced therefrom when the apparatus 10 is again shaken.

Depending upon whether the wagerer prefers to repeat the bet in another game or to wager on another randomly generated number, the apparatus 10 may be carefully slid from one game to another on the lotto card 84 (without disturbing the pattern of bearings 36) or the apparatus 10 may be lifted off of the lotto card 84, shaken in a horizontal plane to rearrange the bearings 36 within the cage 28, and then reapplied to the next game. In either case, the apparatus housing 13 is then again depressed in the direction of arrow 84. Depression of the housing 13 collapses the cage 28 from its normal expanded orientation to its collapsed printing orientation, which in turn causes the bearings 36 to extend partially through the apertures 32 of the apertured member 30 and into local areas of the biasing membrane 40. Localized downward displacement of the resilient biasing membrane 40 under the influence of the bearings 36 causes the marking elements 44 vertically aligned therewith to move from their longitudinally elevated inoperative positions to their longitudinally depressed operative or printing positions in contact with the new game on the lotto card 82.

It will be appreciated that the sizes of the arrays, the number and disposition of the vertically aligned apertures 32, marking elements 44, and body channels 52, as well as the number of bearings 36, may be adjusted to meet the requirements of particular lotto games with regard to the number and configuration (that is, the number and spacing of rows and columns) of numbers for each game and the number of selections to be made per game.

The preferred embodiments of the present invention have been described in terms of a marking means which prints with ink on the lotto card, this being a conventional way of marking the lotto card for the New York State Lottery. Clearly, the principles of the present invention may be adapted to utilize different types of markings. For example, the entire marking element 44 may be replaced by a die intended to perforate or stamp out the selected number in order to mark the selection. Such apparatus would still be useful in conjunction with a base 12 from which the ink pad 22 had been removed, the base here serving to protect the sharp bottom edge of the dice and protect the user therefrom during storage. When a particular lotto game calls for other marking materials to be used, such as ordinary or specially formulated lead, such materials or holders containing such materials may be substituted for the lower portion 48 of the marking element 44 and appropriately secured to the upper portion 46 of the marking element 44 by adhesives, friction fits, etc.

While the illustrated embodiment of the present invention utilizes biasing rods 62 and curves 60 both to secure the body 50 and the apparatus housing 13 together (while permitting limited relative vertical movement therebetween) and to bias the cage 28 to its normal vertically extended configuration (while permitting its collapse under downward pressure), it will be appreciated that, if desired, these functions may be performed by other means. For example, the biasing function may e performed by compression springs disposed in the corners between facing surfaces of the housing top wall 24 and the apertured member 30. The securing function may be performed by transforming the aperture 64 in the apparatus housing sidewall 26 into an elongated vertical slot adapted to receive a wing or flange of the body 50, thereby connecting the housing 13 and body 50 while at the same time permitting relative motion therebetween. Alternatively, the body 50 can be provided with an elongated vertical slot adapted to receive an inwardly extending wing or flange of the apparatus housing sidewall 26.) Indeed, the resilient membrane may be dispensed with entirely and the body 50 and apertured member 30 may be of integral one-piece construction, a spring or other biasing means being provided within each body channel 52 to bias the marking element 44 upwardly.

The apparatus of the present invention can be assembled with similar apparatus to provide functionally independent superassembly configurations which will enable a plurality of games to be marked simultaneously, each with a separate and distinct randomly generated pattern. For example, if two pieces of apparatus are simply welded or cemented side by side (perhaps with a spacer therebetween so that the spacing between the apparatus pieces equals the spacing between the games on the lotto card), a pair of adjacent games can be marked simultaneously. If desired, an integrated superassembly of ten of the apparatus pieces may be used to simultaneously mark an entire card of ten games. Naturally, in formulating any superassembly of apparatus pieces, or base pieces, economies of material and manufacture may be achieved by eliminating parts performing unnecessarily duplicative functions. For example, a superassembly of bases may have all internal side walls removed so that there is a single peripheral sidewall for the composite base. In larger embodiments, such as those adapted to mark ten games at a time, the apparatus loses its portability and ease of carrying, but may be provided by the betting establishment as a convenience to its customers and in its own interest in seeing a multitude of games simultaneously and accurately marked on a card in a single, rapid operation.

To summarize, the present invention provides a portable, hand-operated, mechanical apparatus for making a random wager selection conveniently, easily, rapidly and clearly, thereby increasing the turnover of "random" bettors and indeed encouraging them to play more games due to the speed and ease afforded by the present invention. The present invention is compact and safe to carry, but is readily adaptable to larger versions for marking multiple games at a given time.

Now that the preferred embodiments of the present invention have been shown and described in detail, various modifications and improvements thereon will become readily apparent to those skilled in the art. Accordingly, the appended claims are to be construed broadly and in a manner consistent with the spirit and scope of the invention herein.

I claim:

1. Portable hand-operated mechanical apparatus for making a random wager selection, comprising:

(A) means for generating a substantially random first pattern, said generating means including a cage, cage-biasing means, and a plurality of balls, said cage being moveable between a vertically extended normal configuration enabling random horizontal movement of said balls within said cage and a vertically collapsed printing configuration fixing said balls against horizontal movement within said cage and forcing said balls downwardly, said cage-biasing means biasing said cage to its vertically extended normal configuration and thereby permitting said balls to assume the first pattern after said cage is randomly shaken; and (B) means for marking a wagering sheet with printing in a second pattern essentially the same as said first pattern and constituting a wager selection, said marking means including a plurality of independently selectable marking elements independently moveable between inoperative and operative positions and element-biasing means, said marking elements in said inoperative position being longitudinally elevated and said marking elements in said operative position being longitudinally depressed, said element-biasing means biasing said marking elements to their inoperative position;

said apparatus additionally including a downwardly extending lip for maintaining said marking elements in said inoperative position spaced above the sheet while enabling said marking elements in said operative position to engage the sheet; whereby downward movement of said balls as a result of the movement of said cage to its vertically collapsed printing configuration operatively vertically depresses the marking elements vertically aligned with said balls to their operative positions, a vertical alignment of one of said balls and one of said marking elements being required for said one marking element to mark the sheet.

2. In combination with the apparatus of claim 1, a separable base adapted to receive said apparatus, said base having an upper surface defining a downwardly extending groove adapted to receive therein a lower portion of said lip, said base containing an upwardly facing ink reservoir adapted to be operatively engaged by said marking elements in said inoperative position when said base groove receives said lower lip portion, whereby said marking elements are maintained inked and ready for marking.

3. Integrated mechanical apparatus for making a random wager selection, comprising:

(A) means for generating a substantially random first spatial pattern, said generating means including a cage, cage-biasing means, and a plurality of balls, said cage being moveable between a vertically extended normal configuration enabling random horizontal movement of said balls within said cage and a vertically collapsed printing configuration fixing said balls against horizontal movement within said cage and forcing said balls downwardly, said cage-biasing means biasing said cage to its vertically extended normal configuration and thereby permitting said balls to assume the first pattern after said cage is randomly shaken; and (B) means for marking a wagering sheet with printing in a second spatial pattern essentially the same as said first pattern and constituting a wager selection, said marking means including a plurality of independently selectable marking elements independently moveable between inoperative and operative positions, said marking elements in said inoperative position being longitudinally elevated and said marking elements in said operative position being longitudinally depressed;

whereby downward movement of said balls as a result of the movement of said cage to its vertically collapsed printing configuration operatively vertically depresses the marking elements vertically aligned with said balls to their operative positions, a vertical alignment of one of said balls and one of said marking elements being required for said one marking element to mark the sheet.

4. The apparatus of claim 3 additionally including a downwardly extending lip extending below the bottom of said marking elements in said inoperative position for maintaining said marking elements in said inoperative position spaced from the sheet while enabling said marking elements in said operative position to engage the sheet.

5. The apparatus of claim 3 wherein the upper surface of the floor of said cage defines a plurality of centering depressions, each of said centering depressions being vertically aligned with a respective one of said marking elements.

6. The apparatus of claim 5 wherein said plurality of marking elements and said plurality of centering depressions are disposed in vertically aligned matrices.

7. The apparatus of claim 3 wherein said apparatus is portable, hand-operated and mechanical.

8. The apparatus of claim 3 wherein said marking means comprises means for marking the sheet in said second pattern determined by said first pattern mechanically.

9. The apparatus of claim 3 wherein said second pattern is substantially identical to said first pattern.

10. The apparatus of claim 3 wherein said random generating means and said marking means are structurally and functionally integrated into a single apparatus.

11. The apparatus of claim 3 wherein said first and second patterns are each constituted by a plurality of different elements and said random generating means and said marking means are functionally and structurally integrated such that the time required to mark the sheet with said second pattern, once said first pattern is generated, is independent of the size of the plurality of said elements in said patterns.

12. The apparatus of claim 3 wherein said marking means is in condition to mark the sheet in said second pattern determined by said first pattern immediately upon said generating means generating said first pattern.

13. The apparatus of claim 3 additionally including element-biasing means for biasing said marking elements to their inoperative position.

14. Integral mechanical apparatus for making a random wager selection, comprising:

(A) means for generating a substantially random first spatial pattern, said generating means including a cage and a plurality of balls, said cage being moveable between a vertically extended normal configuration enabling random horizontal movement of said balls within said cage and a vertically collapsed printing configuration fixing said balls against horizontal movement within said cage and forcing said balls downwardly, said cage in its vertically extended normal configuration permitting said balls to assume the first pattern after said cage is randomly shaken; and (B) means for marking a wagering sheet with printing in a second spatial pattern essentially the same as said first pattern and constituting a wager selection, said marking means including a plurality of independently selectable marking elements independently moveable between inoperative and operative positions and a single common element-biasing means active on each of said elements, said marking elements in said inoperative position being longitudinally elevated and said marking elements in said operative position being longitudinally depressed, said element-biasing means biasing said marking elements to their inoperative position;

whereby downward movement of said balls as a result of the movement of said cage to its vertically collapsed printing configuration operatively vertically depresses the marking elements vertically aligned with said balls to their operative positions, a vertical alignment of one of said balls and one of said marking elements being required for said one marking element to mark the sheet.

15. The apparatus of claim 14 additionally including means biasing said cage to its vertically extended normal configuration.

16. The apparatus of claim 18 wherein said single common biasing means is a thin elastic membrane.

17. The apparatus of claim 14 wherein each of said marking elements is secured to said common biasing means for vertical movement therewith.

18. Integrated mechanical apparatus for making a random water selection, comprising:

(A) means for generating a substantially random first spatial pattern, said generating means including a cage and a plurality of balls, said cage being moveable between a vertically extended normal configuration enabling random horizontal movement of said balls within said cage and a vertically collapsed printing configuration fixing said balls against horizontal movement within said cage and forcing said balls downwardly, said cage in its vertically extended normal configuration permitting said balls to assume the first pattern after said cage is randomly shaken;

(B) means for marking a wagering sheet with printing in a second spatial pattern essentially the same as said first pattern and constituting a wager selection, said marking means including a plurality of independently selectable marking elements independently moveable between inoperative and operative positions, said marking elements in said inoperative position being longitudinally elevated and said marking elements in said operative position being longitudinally depressed;

(C) a downwardly extending lip for maintaining said marking elements in said inoperative position spaced above the sheet while enabling said marking elements in said operative position to engage the sheet; and (D) a separable base having an upper surface defining a downwardly extending groove adapted to receive therein a lower portion of said lip, said base containing an upwardly facing ink reservoir adapted to be operatively engaged by said marking elements in said inoperative position when said base groove receives said lower lip portion, whereby said marking elements are maintained inked and ready for marking.

19. The apparatus of claim 18 wherein said cage is movable between a vertically extended normal configuration enabling random horizontal movement of said balls in said cage and a vertically collapsed printing configuration fixing said balls against horizontal movement within said cage and forcing said balls downwardly to operatively vertically depress the vertically aligned marking elements to their operative position.

20. The apparatus of claim 18 additionally including means active on each of said marking elements and biasing them to their inoperative positions.

21. The apparatus of claim 20 wherein each of said marking elements is secured to said biasing means for vertical movement therewith.

22. The apparatus of claim 18 wherein said marking elements are in condition to mark the sheet in said second pattern determined by said first pattern immediately upon said balls assuming said first pattern.

* * * * *